US005949466A

United States Patent [19]

Kerr et al.

[11] Patent Number: 5,949,466

[45] Date of Patent: Sep. 7, 1999

[54] EXPOSING IMAGESETTER RECORDING FILM TO A DYE COLLECTION SHEET ON A TRANSFER APPARATUS

[75] Inventors: Roger S. Kerr, Brockport; John D. Gentzke, Rochester, both of N.Y.

[73] Assignee: Eastman Kodak Company, Rochester, N.Y.

[21] Appl. No.: 09/071,084

[22] Filed: May 1, 1998

[51] Int. Cl.[6] ..... B41M 5/26

[52] U.S. Cl. ..... 347/213; 347/215; 347/262; 347/264; 346/138; 430/269

[58] Field of Search ..... 347/172, 213, 347/221, 224, 262, 215, 264; 346/134, 138; 430/269

[56] References Cited

U.S. PATENT DOCUMENTS 5,280,307 1/1994 Parsons ..... 346/134
5,699,099 12/1997 Garand et al. ..... 347/172
5,725,993 3/1998 Bringley et al. ..... 430/269

*Primary Examiner*—N. Le
*Assistant Examiner*—Hai C. Pham
*Attorney, Agent, or Firm*—Nelson Adrian Blish; David A. Novais

[57] ABSTRACT

The present invention is for an image processing apparatus (10) for a method of exposing imagesetter recording film (42) on a color-proofing apparatus. The method comprises the steps of loading a sheet of dye collection support (45) on a vacuum imaging drum (300) and loading a first sheet of imagesetter recording film in registration with the dye collection support. The first sheet of imagesetter recording film is loaded dye side down. An intended image is formed on the first sheet of imagesetter recording film by removing dye from the first sheet of imagesetter recording film which is collected on the dye collection support. Additional sheets of imagesetter recording film and other embodiments are prepared in a similar manner. In a further embodiment, the dye collection support is removed from the vacuum imaging drum as each sheet of imagesetter recording film is removed to provide a blue line image.

12 Claims, 9 Drawing Sheets

EXPOSING IMAGESETTER RECORDING FILM TO A DYE COLLECTION SHEET ON A TRANSFER APPARATUS

CROSS REFERENCE TO RELATED APPLICATIONS

U.S. Ser. No. 08/989,761, filed Dec. 12, 1997, entitled EXPOSING IMAGESETTER RECORDING FILM ON A COLOR-PROOFING APPARATUS, by Roger S. Kerr and John D. Gentzke; and U.S. Ser. No. 09/052,185, filed Mar. 31, 1998, entitled DIRECT WRITE PLATES ON A THERMAL DYE TRANSFER APPARATUS, by Roger S. Kerr and John D. Gentzke.

FIELD OF THE INVENTION

This invention relates in general to an image processing apparatus and in particular to exposing imagesetter recording film on a vacuum imaging drum of a color-proofer.

BACKGROUND OF THE INVENTION

Pre-press color-proofing is a procedure that is used by the printing industry for creating representative images of printed material without the high cost and time that is required to actually produce printing plates and set up a high-speed, high volume, printing press to produce an example of the intended image. The process of producing an example of an intended image may require several corrections and be reproduced several times to satisfy the customer which, if printing plates were produced corresponding to each correction, would result in significantly higher-costs to the customer.

A commercially available image processing apparatus is described in commonly assigned U.S. Pat. No. 5,268,708. This image processing apparatus forms an intended image on a sheet of thermal print media by transferring dye from several sheets of dye donor material, one sheet at a time, to the thermal print media. Thermal energy is applied to the dye donor sheets by a laser to form the intended image.

Once the intended image meets the customers requirements, imagesetter recording films required for exposing printing plates are produced. These imagesetter recording films are generated on a separate apparatus such as an imagesetter. The inagesetter recording films are used to expose printing plates on yet another machine. Printing plates may also be produced on a separate apparatus without using imagesetter film for exposing.

Although available image processing apparatus' operate in a satisfactory manner, a need exists to expose imagesetter recording film on the same apparatus that is used to generate color proofs. Producing imagesetter recording film on the same machine used to produce color proofs eliminates the need for a separate machine. However, producing imagesetter recording film produces residual dye that must be removed from the color-proofer, otherwise the color proofer performance will deteriorate due to buildup of dye residue.

SUMMARY OF THE INVENTION

It is the object of the present invention to expose an intended image on imagesetter recording film using the same apparatus which produces a color proof of the intended image.

The present invention is directed to overcoming one or more of the problems set forth above. Briefly summarized, according to one aspect of the present invention, the present invention is for an image processing apparatus for a method of exposing imagesetter recording film on a color-proofing apparatus. The method comprises the steps of loading a sheet of dye collection support on a vacuum imaging drum and loading a first sheet of imagesetter recording film in registration with the dye collection support. The first sheet of imagesetter recording film is loaded dye side down. An intended image is formed on the first sheet of imagesetter recording film by removing dye from the first sheet of imagesetter recording film which is collected on the dye collection support. Additional sheets of imagesetter recording film and other embodiments are prepared in a similar manner. In a further embodiment, the dye collection support is removed from the vacuum imaging drum as each sheet of imagesetter recording film is removed to provide a blue line image.

Using the same image file from the same Raster Image Processor (RIP), fed through the same electronics to the same print head, the imagesetter film is exposed transferring dye to a dye collection support material to create the intended image on the imagesetter recording film required to produce the printing plates. Because the dye or removable layer is facing the dye collection support material on the drum no vacuum system is required to vacuum the dye away from the print head area, that is remove from the imagesetter film when it is exposed by the print head and a blue line image of that film is generated on the dye collection support material.

It is an advantage of the present invention to expose imagesetter recording film on the same apparatus used to produce the four color proof.

It is an advantage of the present invention that the imagesetter recording film is produced using the same Raster Image Processor (RIP) used to produce the four color proof.

It is an advantage of the present invention that the imagesetter recording film is produced using the same writing electronics used to produce the four color proof.

It is an advantage of the present invention that the imagesetter recording film is produced using the same print head used to produce the four color proof.

It is an advantage of the present invention that dye removed from the imagesetter recording film is transferred to a dye collection support material using the same vacuum drum used to produce the four color proof.

It is an advantage of the present invention that a blue line image is produced on dye collection support material at the same time the imagesetter recording films are being exposed.

It is an advantage of the present invention that a separate dye collection support vacuum system is not needed to remove dye removed from the imagesetter recording film.

DETAILED DESCRIPTION OF THE INVENTION

Figure 1:
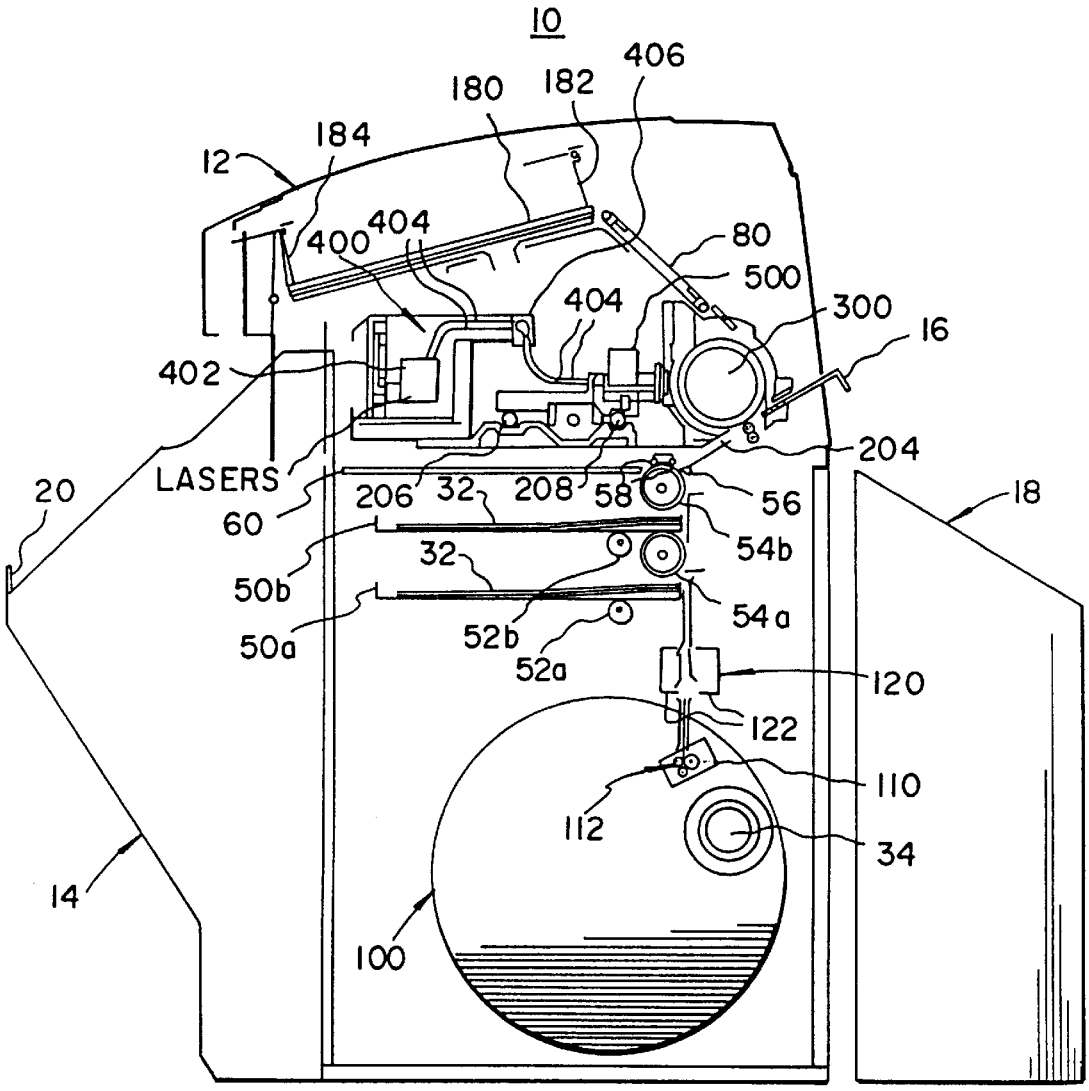
FIG. 1 is a side view in vertical cross-section of an image processing apparatus of the present invention.

Referring to FIG. 1, there is illustrated an image processing apparatus 10 according to the present invention having an image processor housing 12 which provides a protective cover. A movable, hinged image processor door 14 is attached to the front portion of the image processor housing 12 permitting access to the two sheet material trays, lower sheet material tray 50*a* and upper sheet material tray 50*b*, that are positioned in the interior portion of the image processor housing 12 for supporting thermal print media 32, thereon. Only one of the sheet material trays 50 will dispense the thermal print media 32 out of its sheet material tray 50 to create an intended image thereon; the alternate sheet material tray either holds an alternative type of thermal print media 32 or functions as a back up sheet material tray. In this regard, the lower sheet material tray 50*a* includes a lower media lift cam 52*a* for lifting the lower sheet material tray 50*a* and ultimately the thermal print media 32, upwardly toward a rotatable, lower media roller 54*a* and toward a second rotatable, upper media roller 54*b* which, when both are rotated, permits the thermal print media 32 to be pulled upwardly towards a media guide 56. The upper sheet material tray 50*b* includes a upper media lift cam 52*b* for lifting the upper sheet material tray 50*b* and ultimately the thermal print media 32 towards the upper media roller 54*b* which directs it towards the media guide 56.

The movable media guide 56 directs the thermal print media 32 under a pair of media guide rollers 58 which engages the thermal print media 32 for assisting the upper media roller 54*b* in directing it onto the media staging tray 60. The media guide 56 is attached and hinged to the lathe bed scanning frame 202 at one end, anti is uninhibited at its other end for permitting multiple positioning of the media guide 56. The media guide 56 then rotates its uninhibited end downwardly, as illustrated in the position shown, and the direction of rotation of the upper media. roller 54*b* is reversed for moving the thermal print medium receiver sheet material 32 resting on the media staging tray 60 under the pair of media guide roller 58, upwardly through an entrance passageway 204 and around a rotatable vacuum imaging drum 300.

A roll 30 of dye donor material 34 is connected to the media carousel 100 in a lower portion of the image processor housing 12. Four rolls 30 are used, but only one is shown for clarity. Each roll 30 includes a dye donor material 34 of a different color, typically black, yellow, magenta and cyan. These dye donor materials 34 are ultimately cut into dye donor sheet materials 36 and passed to the vacuum imaging drum 300 for forming the medium from which dyes imbedded therein are passed to the thermal print media 32 resting thereon, which process is described in detail herein below. In this regard, a media drive mechanism 110 is attached to each roll 30 of dye donor material 34, and includes three media drive rollers 112 through which the dye donor material 34 of interest is metered upwardly into a media knife assembly 120. After the dye donor material 34 reaches; a predetermined position, the media drive rollers 112 cease driving the dye donor material 34 and the two media knife blades 122 positioned at the bottom portion of the media knife assembly 120 cut the dye donor material 34 into dye donor sheet materials 36. The lower media roller 54*b* and the upper media roller 54*b* along with the media guide 56 then pass the dye donor sheet material 36 onto the media staging tray 60 and ultimately to the vacuum imaging drum 300 and in registration with the thermal print media 32 using the same process as described above for passing the thermal print media 32 onto the vacuum imaging drum 300. The dye donor sheet material 36 now rests atop the thermal print media 32 with a narrow gap between the two created by microbeads imbedded in the surface of the thermal print media 32.

A laser assembly 400 includes a quantity of laser diodes 402 in its interior, the lasers 402 are connected via fiber optic cables 404 to a distribution block 406 and ultimately to the printhead 500. The printhead 500 directs thermal energy received from the laser diodes 402 causing the dye donor sheet material 36 to pass the desired color across the gap to the thermal print media 32. The printhead 500 is attached to a lead screw 250 via the lead screw drive nut 254 and drive coupling 256 (not shown in FIG. 1) for permitting movement axially along the longitudinal axis of the vacuum imaging drum 300 for transferring the data to create the intended image onto the thermal print media 32.

For writing, the vacuum imaging drum 300 rotates at a constant velocity, and the Printhead 500 begins at one end of the thermal print media 32 and traverse the entire length of the thermal print media 32 for completing the transfer process for the particular dye donor sheet material 36 resting on the thermal print media 32. After the printhead 500 has completed the transfer process, for the particular dye donor sheet material 36 resting on the thermal print media 32 the dye donor sheet material 36 is then removed from the vacuum imaging drum 300 and transferred out the image processor housing 12 via a skive or ejection chute 16. The dye donor sheet material 36 eventually comes to rest in a waste bin 18 for removal by the user. The above described process is then repeated for the other three rolls 30 of dye donor materials 34.

After the color from all four sheets of the dye donor sheet materials 36 have been transferred and the dye donor sheet materials 36 have been removed from the vacuum imaging drum 300, the thermal print media 32 is removed from the vacuum imaging drum 300 and transported via a transport mechanism 80 to a color binding assembly 180. The entrance door 182 of the color binding assembly 180 is opened for permitting the thermal print media 32 to enter the color binding assembly 180, and shuts once the thermal print media 32 comes to rest in the color binding assembly 180. The color binding assembly 180 processes the thermal print media 32 for further binding the transferred colors on the thermal print media 32 and for sealing the microbeads thereon. After the color binding process has been completed, the media exit door 184 is opened and the thermal print media 32 with the intended image thereon passes out of the color binding assembly 180 and the image processor housing 12 and comes to rest against a media stop 20.

Figure 2:
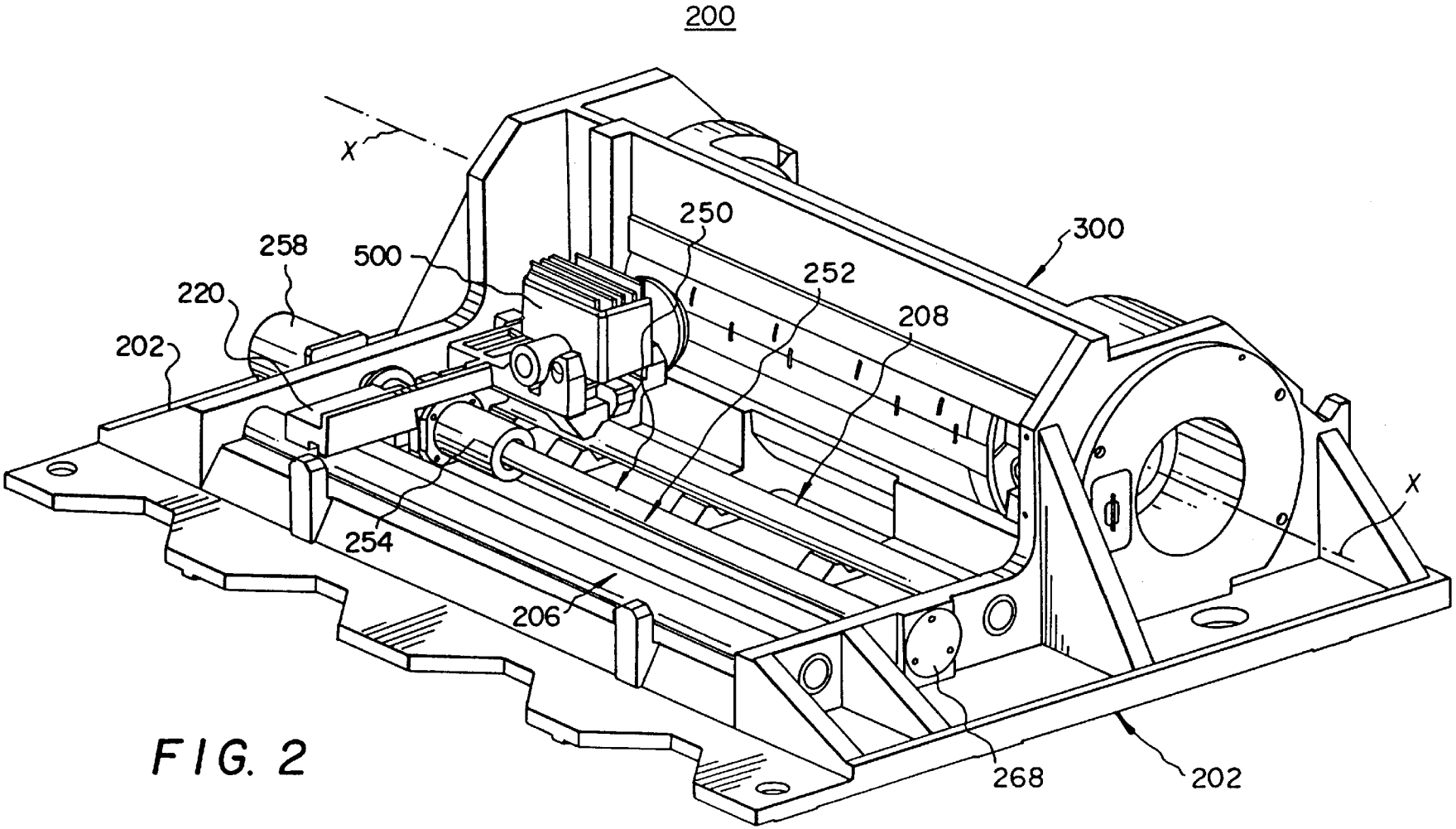
FIG. 2 is a perspective view of the lathe bed scanning subsystem or write engine of the present invention.

Referring to FIG. 2, there is illustrated a perspective view of the lathe bed scanning subsystem 200 of the image processing apparatus 10, including the vacuum imaging, drum 300, printhead 500 and lead screw 250 assembled in the lathe bed scanning frame 202. The vacuum imaging drum 300 is mounted for rotation about an axis X in the lathe bed scanning frame 202. The printhead 500 is movable with respect to the vacuum imaging drum 300, and is arranged to direct a beam of light to the dye donor sheet material 36. The beam of light from the printhead 500 for each laser diode 402 (not shown in FIG. 2) is modulated individually by modulated electronic signals from the image processing apparatus 10, which are representative of the shape and color of the original image, so that the color on the dye donor sheet material 36 is heated to cause volatilization only in those areas in which its presence is required on the thermal print media 32 to reconstruct the shape and color of the original image.

The printhead 500 is mounted on a movable translation stage member 220 which, in turn, is supported for low friction slidable movement on translation bearing rods 206 and 208. The translation bearing rods 206 and 208 are sufficiently rigid so that they do not sag or distort between their mounting points and are arranged as parallel as possible with the axis X of the vacuum imaging drum 300 with the axis of the printhead 500 perpendicular to the axis X of the vacuum imaging drum 300 axis. The front translation bearing rod 208 locates the translation stage member 220 in the vertical and the horizontal directions with respect to axis X of the vacuum imaging drum 300. The rear translation bearing rod 206 locates the translation stage member 220 only with respect to rotation of the translation stage member 220 about the front translation bearing rod 208 so that there is no over-constraint condition of the translation stage member 220 which might cause it to bind, chatter, or otherwise impart undesirable vibration or jitters to the printhead 500 during the generation of an intended image.

Figure 3:
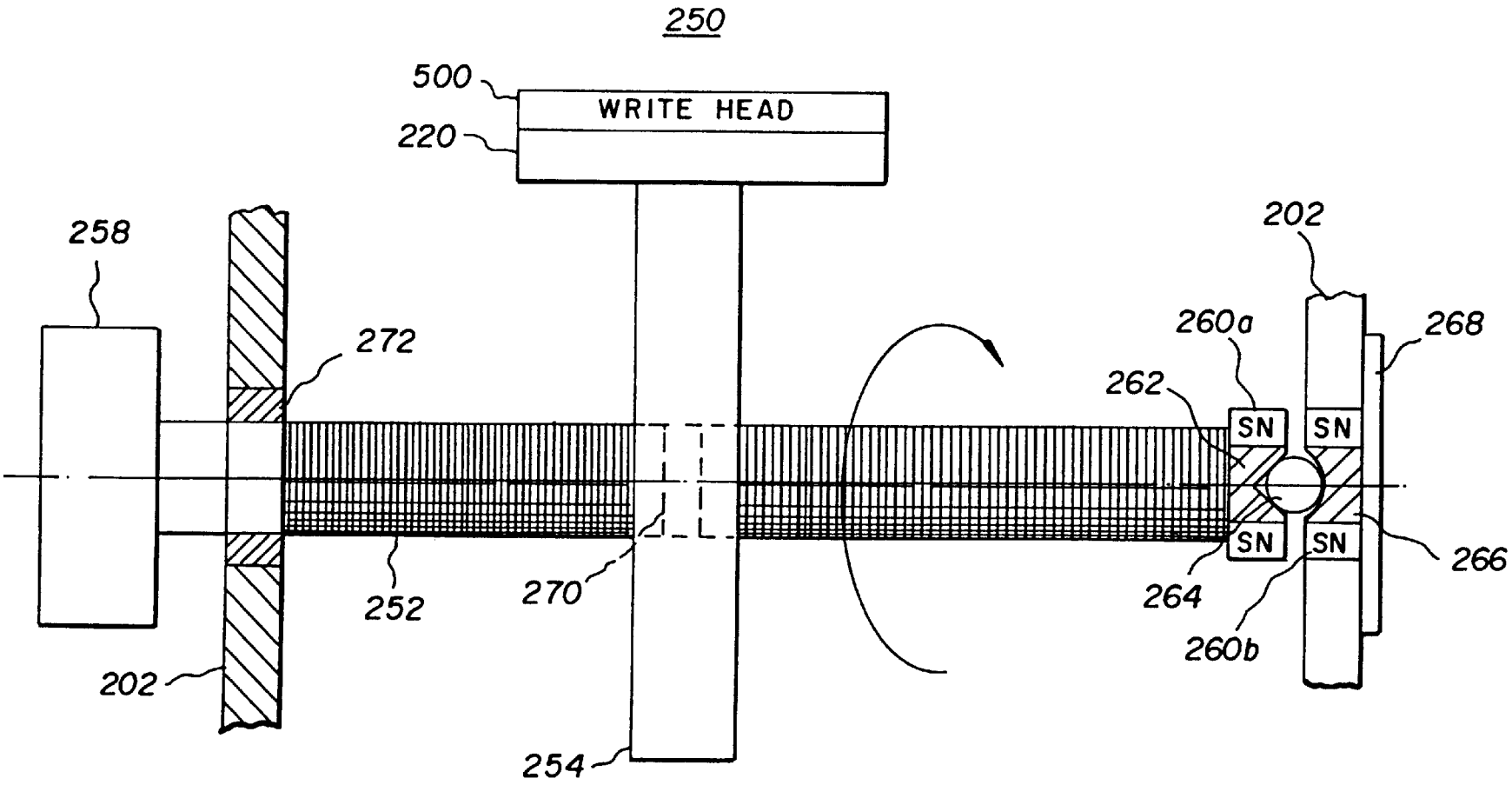
FIG. 3 is a top view in horizontal cross-section, partially in phantom, of the lead screw of the present invention.

Referring to FIGS. 2 and 3, a lead screw 250 is shown which includes an elongated, threaded shaft 252 which is attached to the linear drive motor 258 on its drive end and to the lathe bed scanning frame 202 by means of a radial bearing 272. A lead screw drive nut 254 includes grooves in its hollowed-out center portion 70 for mating with the threads of the threaded shaft 252 for permitting the lead screw drive nut 254 to move axially along the threaded shaft 252 as the threaded shaft 252 is rotated by the linear drive motor 258. The lead screw drive nut 254 is integrally attached to the to the printhead 500 through the lead screw coupling 256 (not shown) and the translation stage member 220 at its periphery so that as the threaded shaft 252 is rotated by the linear drive motor 258 the lead screw drive nut 254 moves axially along the threaded shaft 252 which in turn moves the translation stage member 220 and ultimately the printhead 500 axially along the vacuum imaging drum 300.

As best illustrated in FIG. 3, an annular-shaped axial load magnet 260*a* is integrally attached to the driven end of the threaded shaft 252, and is in a spaced apart relationship with another annular-shaped axial load magnet 260*b* attached to the lathe bed scanning frame 202. The axial load magnets 260*a* and 260*b* are preferably made of rare-earth materials such as neodymium-iron-boron. A generally circular-shaped boss 262 part of the threaded shaft 252 rests in the hollowed-out portion of the annular-shaped axial load magnet 260*a*, and includes a generally V-shaped surface at the end for receiving a ball bearing 264. A circular-shaped insert 266 is placed in the hollowed-out portion of the other annular-shaped axial load magnet 260*b*, and includes an accurate-shaped surface on one end for receiving the ball bearing 264, and a flat surface at its other end for receiving an end cap 268 placed over the annular-shaped axial load magnet 260*b* and attached to the lathe bed scanning frame 202 for protectively covering the annular-shaped axial load magnet 260*b* and providing an axial stop for the lead screw 250. The circular shaped insert 266 is preferably made of material such as Rulon J™ or Delrin AF™, both well known in the art.

The lead screw 250 operates as follows. The linear drive motor 258 is energized and imparts rotation to the lead screw 250, as indicated by the arrows, causing the, lead screw drive nut 254 to move axially along the threaded shaft 252. The aniular-shaped axial load magnets 260*a* and 260*b* are magnetically attracted to each other which prevents axial movement of the lead screw 250. The ball bearing 264, however, permits rotation of the lead screw 250 while maintaining the positional relationship of the annular-shaped axial load magnets 260, i.e., slightly spaced apart, which prevents mechanical friction between them while obviously permitting the threaded shaft 252 to rotate.

The print head 500 travels in a path along the vacuum imaging drum 300, while being moved at a speed synchronous with the vacuum imaging drum 300 rotation and proportional to the width of the writing swath 450, not shown. The pattern that the print head 500 transfers to the thermal print media 32 along the vacuum imaging drum 300, is a helix.

Figure 4:
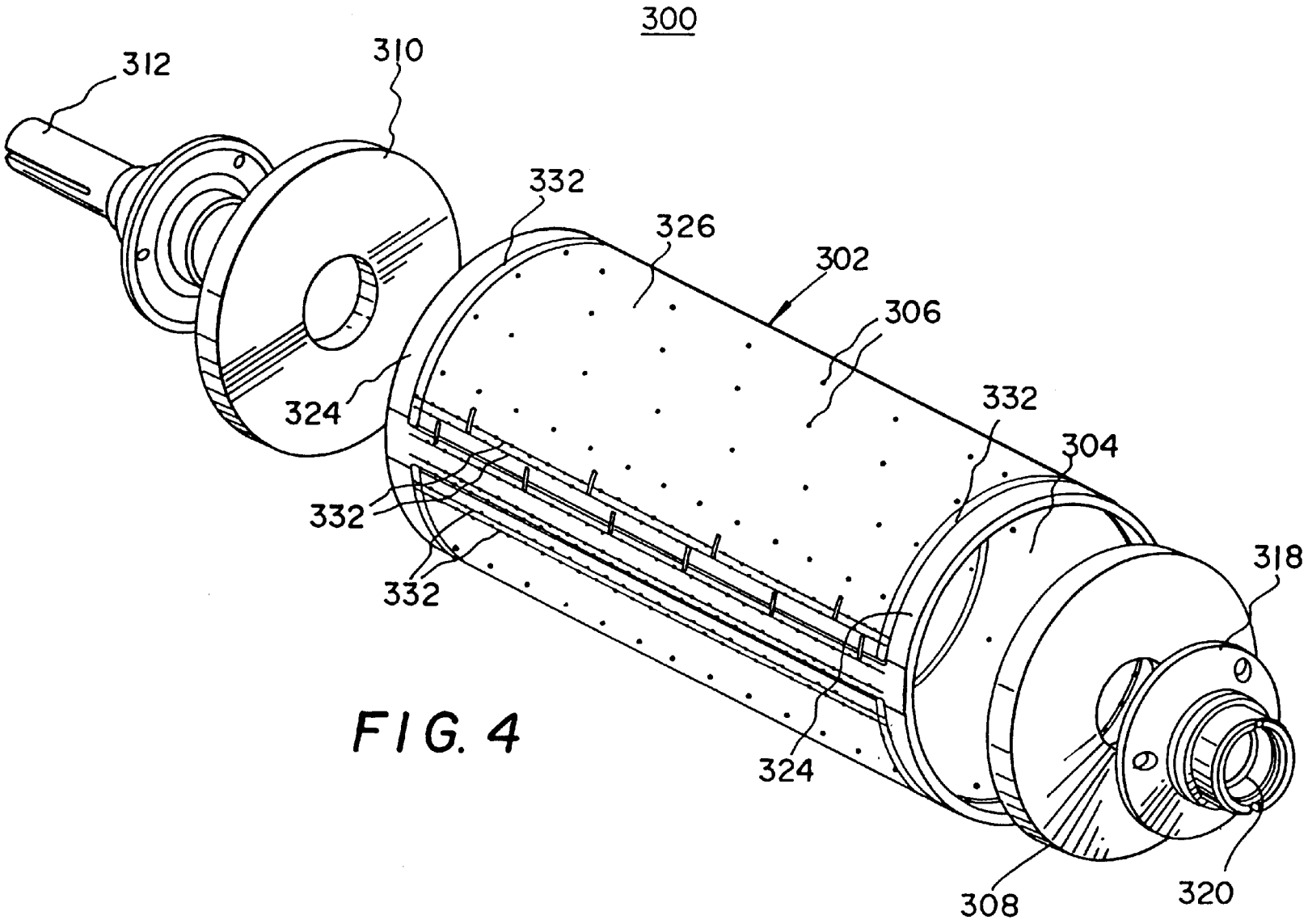
FIG. 4 is a exploded, perspective view of the vacuum imaging drum of the present invention.

Referring to FIG. 4, there is illustrated an exploded view of the vacuum imaging drum 300. The vacuum imaging drum 300 has a cylindrical shaped vacuum dram housing 302 that has a hollowed-out interior portion 304, and further includes a plurality of vacuum grooves 332 and vacuum holes 306 which extend through the vacuum drum housing 302 for permitting a vacuum to be applied from the hollowed-out interior portion 304 of the vacuum imaging drum 300 for supporting and maintaining position of the thermal print media 32, and the dye donor sheet material 36, as the vacuum imaging drum 300 rotates.

The ends of the vacuum imaging drum 300 are closed by the vacuum end plate 308, and the drive end plate 310. The drive end plate 310, is provided with a centrally disposed drive spindle 312 which extends outwardly therefrom through a support bearing 314, the vacuum end plate 308 is provided with a centrally disposed vacuum spindle 318 which extends outwardly therefrom through another support bearing 314.

The drive spindle 312 extends through the support bearing 314 and is stepped down to receive a DC drive motor armature, not shown, which is held on by means of a drive nut. A DC motor stator is stationary held by the late bed scanning frame member 202, encircling the DC drive motor armature 316 to form a reversible, variable DC drive motor for the vacuum imaging drum 300. At the end of the drive spindle 312 a drum encoder is mounted to provide the timing signals to the image processing apparatus 10.

The vacuum spindle 318 is provided with a central vacuum opening 320 which is in alignment with a vacuum fitting 222 with an external flange that is rigidly mounted to the lathe bed scanning frame 202. The vacuum fitting 222 has an extension which extends within but is closely spaced from the vacuum spindle 318, thus forming a small clearance. With this configuration, a slight vacuum leak is provided between the outer diameter of the vacuum fitting 222 and the inner diameter of the central vacuum opening 320 of the vacuum spindle 318. This assures that no contact exists between the vacuum fitting 222 and the vacuum imaging drum 300 which might impart uneven movement or jitters to the vacuum imaging drum 300 during its rotation.

The opposite end of the vacuum fitting 222 is connected to a high-volume vacuum blower 224 which is capable of producing 93–112 mm of mercury at an air flow volume of 28–33 liters/sec, and provides the vacuum to the vacuum imaging drum 300 supporting the various internal vacuum levels of the vacuum imaging drum 300 required during the loading, scanning and unloading of the thermal print media 32 and the dye donor sheet materials 36. With no media loaded on the vacuum imaging drum 300 the internal vacuum level of the vacuum imaging drum 300 is approximately 18–28 mm of mercury. With just the thermal print media 32 loaded on the vacuum imaging drum 300 the internal vacuum level of the vacuum imaging drum 300 is approximately 37–46 mm of mercury. This level is required such that when a dye donor sheet material 36 is removed, the thermal print media 32 does not move otherwise color to color registration will be able to be maintained. With both the thermal print media 32 and dye donor sheet material 36 completely loaded on the vacuum imaging drum 300 the internal vacuum level of the vacuum imaging drum 300 is approximately 93–112 mm of mercury in this configuration.

Figure 5:
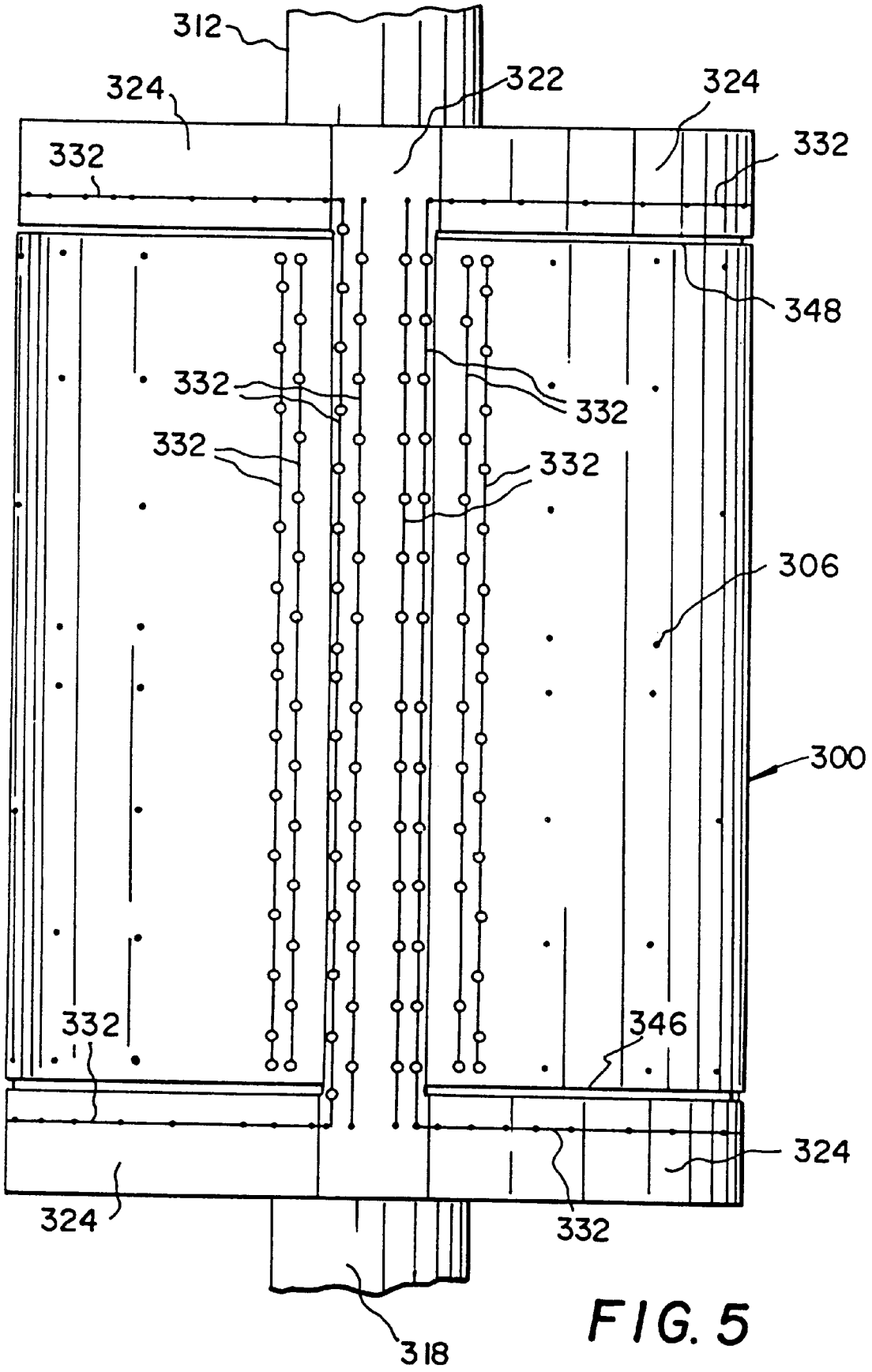
FIG. 5 is a plane view of the vacuum imaging drum surface of the present invention.

The outer surface of the vacuum imaging drum 300 is provided with an axially extending flat 322, shown FIG. 5, which extends approximately 8 degrees of the vacuum imaging drum 300 circumference. The vacuum imaging drum 300 is also provided with donor support rings 324 which form a circumferential recess 326 which extends circumferentially from one side of the axially extending flat 322 circumferentially around the vacuum imaging drum 300 to the other side of the axially extending flat 322, and from approximately 25 mm from one end of the vacuum imaging drum 300 to approximately 25 mm from the other end of the vacuum imaging drum 300.

Figure 6A:
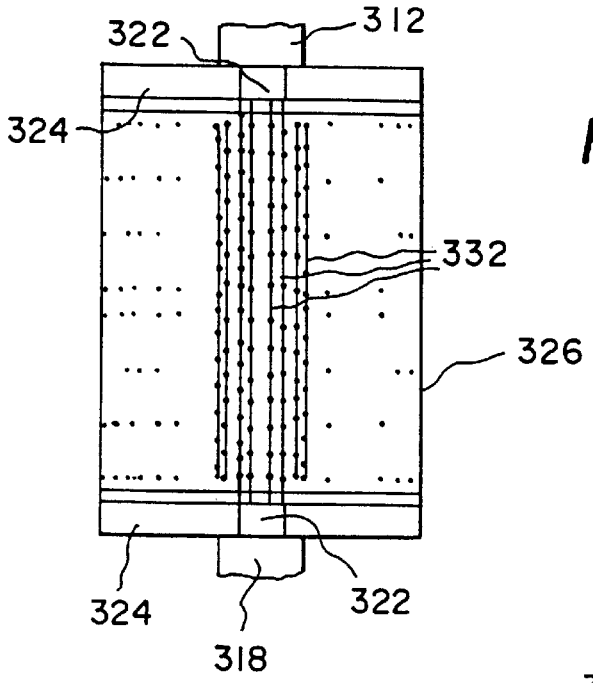
FIGS. 6*a*–6*c* is a plane view of the vacuum imaging drum showing the sequence of placement for the thermal print media and dye donor sheet material.
Figure 6B:
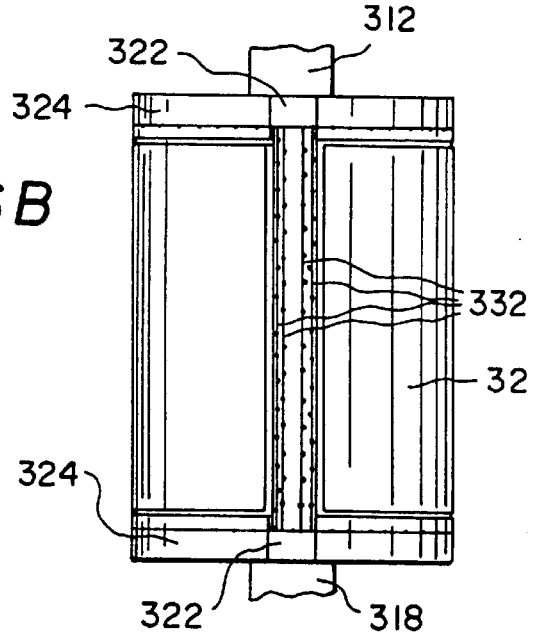
Figure 6C:
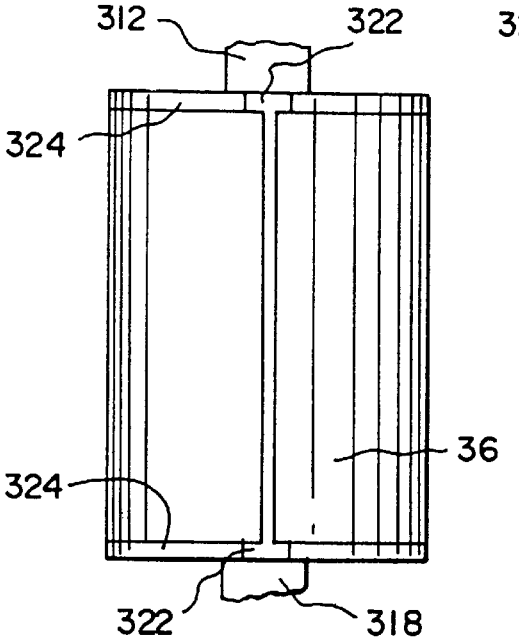
Figure 7:
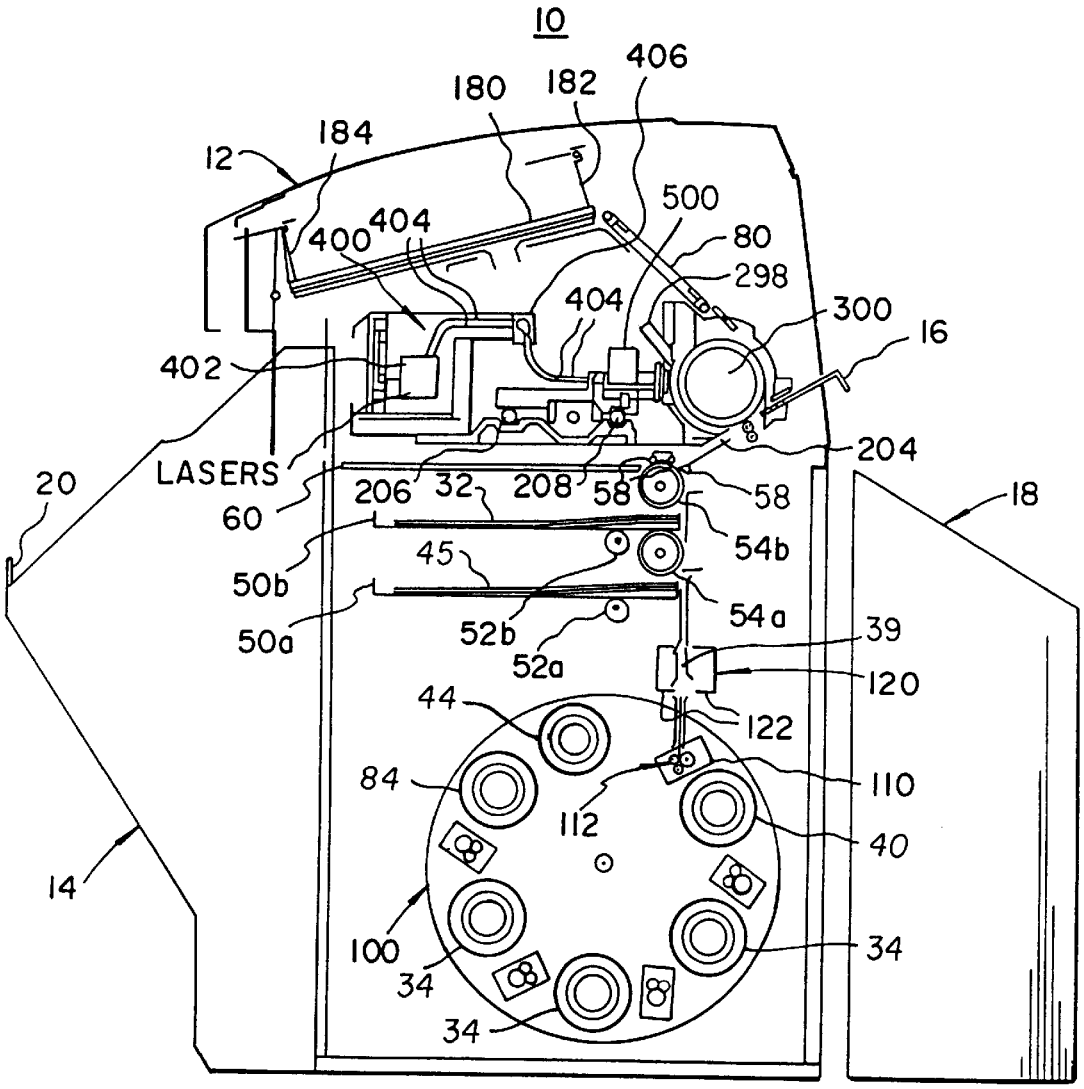
FIG. 7 is a side view in vertical cross-section of an image processing apparatus of the present invention.
Figure 8:
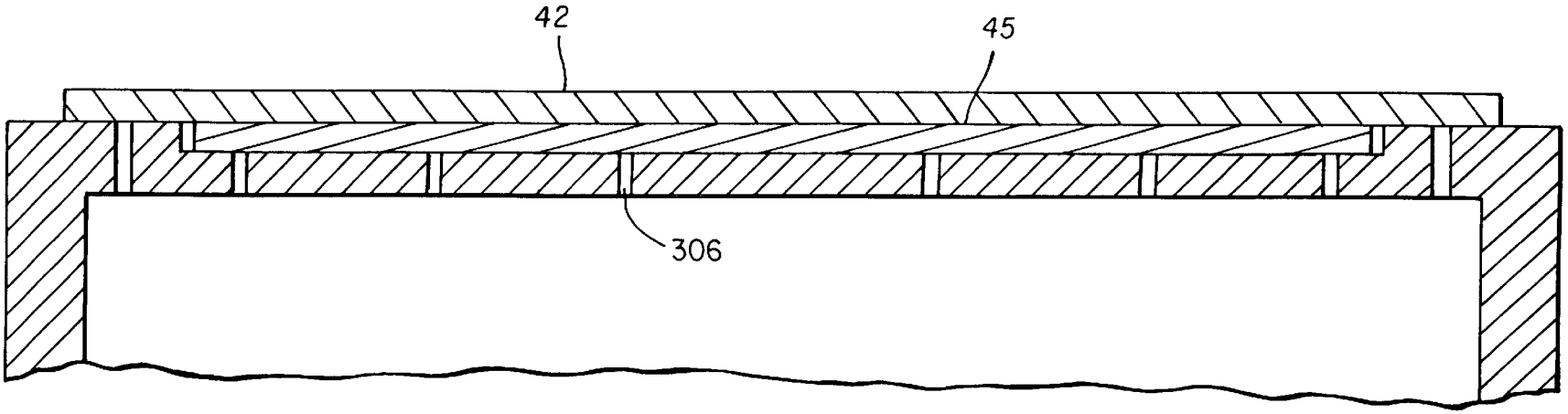
FIG. 8 is a partial section view of the vacuum imaging drum with dye collection support material and imagesetter film.

The thermal print media 32 when mounted on the vacuum imaging drum is seated within the circumferential recess 326, as shown FIG. 6*a*–6*c*. The donor support rings 324 have a thickness substantially equal to the thermal print media 32 thickness seated there between which is approximately 0.1 mm in thickness. The purpose of the circumferential recess 326 on the vacuum imaging drum 300 surface is to eliminate any creases in the dye donor sheet material 36, as they are drawn down over the thermal print media 32 during the loading of the dye donor sheet material 36. This ensures that no folds or creases will be generated in the dye donor sheet material 36 which could extend into the image area and seriously adversely affect the intended image. The circumferential recess 326 also substantially eliminates the entrapment of air along the edge of the thermal print media 32, where it is difficult for the vacuum holes 306 in the vacuum imaging drum 300 surface to assure the removal of the entrapped air. Any residual air between the thermal print media 32 and the dye donor sheet material 36, can also adversely affect the intended image.

When using the direct digital color-proofer as an imagesetter. The dye collection support roll material 44 and imagesetter film 40 are mounted in the media carousel 100 located in the lower portion of the image processor housing 12. Up to six rolls 30 can be used. Each roll 34 includes a dye donor material of a different color, typically black, yellow, magenta and cyan, a dye collection support roll material 44 and an imagesetter film roll 40. The dye collection support material in sheet form 45 could also be loaded from the alternate media tray 50*a*.

The dye collection support material 44 and imagesetter film 40 are ultimately cut into dye collection support sheets 45 and imagesetter film sheets 42 and passed to the vacuum imaging drum 300 for forming the medium from which dye imbedded therein is removed, which process as described in detail below. In this regard, a media drive mechanism 110 is attached to a roll 30 of the dye collection support 44, and includes three media drive rollers 112 through which dye collection support 44 is metered upwardly into a media knife assembly 120. After the dye collection support 44 reaches a predetermined position, the media drive rollers 112 cease driving the dye collection support 44 and the two media knife blades 122 positioned at the bottom portion of the media knife assembly 120 cut the dye collection support 44 into a dye collection support sheet 45. The lower media roller 54*a* and the upper media roller 54*b* along with the media guide 56 then pass the dye collection support sheet 45 onto the media staging tray 60 and ultimately to the vacuum imaging drum 300 using the same process as described above for passing the thermal print media 32 onto the vacuum imaging drum 300.

The media drive mechanism 110, attached to a roll 30 of the imagesetter film 40, and includes three media drive rollers 112 through which imagesetter film 40 is metered upwardly into a media knife assembly 120. After imagesetter film 40 reaches a predetermined position, the media drive rollers 112 cease driving the imagesetter film 40 and the two media knife blades 122 positioned at the bottom portion of the media knife assembly 120 cut the imagesetter film 40 into imagesetter film sheets 42. The lower media roller 54*a* and the upper media roller 54*b* along with the media guide 56 then pass the imagesetter film sheet 42 onto the media staging tray 60 and ultimately to the vacuum imaging drum 300 using the same process as described above for passing the thermal print media 32 onto the vacuum imaging drum 300.

The printhead 500 directs thermal energy received from the laser diodes 402 causing the dye on the imagesetter film sheet 42 to be removed. The dye is transferred from the imagesetter film sheet 42 to the dye collection support sheet 45. The printhead 500 is attached to a lead screw 250 via the lead screw drive nut 254 and drive coupling 256 for permitting movement axially along the longitudinal axis of the vacuum imaging drum 300 for transferring the data to create the intended image onto the imagesetter film sheet 42.

The intended image is created on the imagesetter film 42 using the same process predisclosed for proofing. This process also generates a positive image on the dye collection support sheet 45 that can be used as a blue line image.

When the first imagesetter film sheet 42 is completed, it is removed from the vacuum imaging drum 300 and transported via a transport mechanism 80 to a color bindiig assembly 180. The entrance door 182 of the color binding assembly 180 is opened for permitting the imagesetter film sheet 42 to enter the color binding assembly 180. The imagesetter film sheet 42 may be post-baked at this point for stabilization of the image on the imagesetter film sheet 42. The media exit door 184 is opened and the imagesetter film sheet 42 with the intended image thereon passes out of the color binding assembly 180 and the image processor housing 12 and comes to rest against a media stop 20. A second sheet can then be loaded over the dye collection support sheet 45 and imaged or the dye collection support sheet 45 can be transferred out the image processor housing 12 via a skive or ejection chute 16. The dye collection support sheet 45 eventually comes to rest in a waste bin 18 for removal by the user. If the dye collection support sheet 45 is to be used as a blue line image, it would be exited after each imagesetter film sheet 42 is imaged.

Figure 9A:
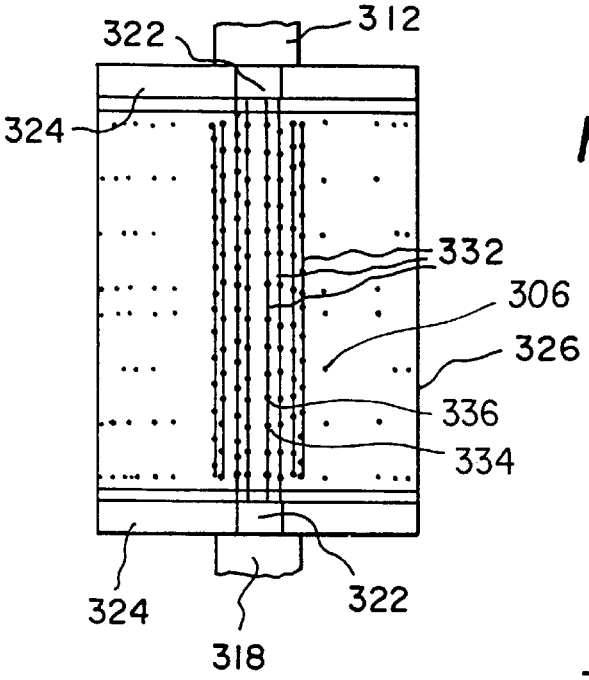
FIGS. 9*a*–9*c* are plane views of the vacuum imaging drum showing the sequence of placement of dye collection support material and imagesetter film.
Figure 9B:
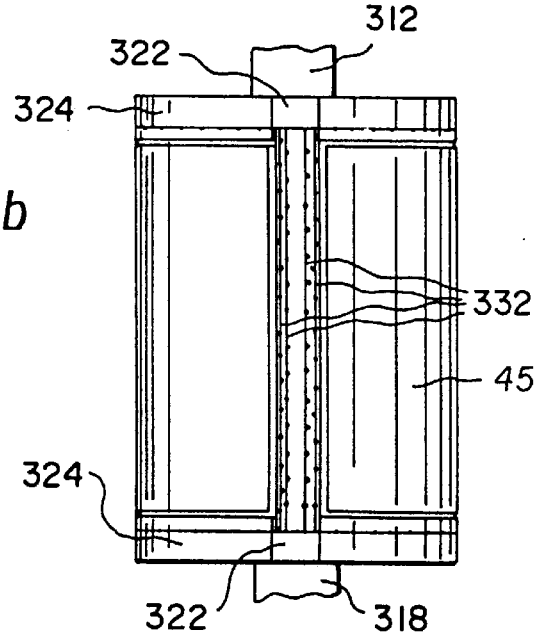
Figure 9C:
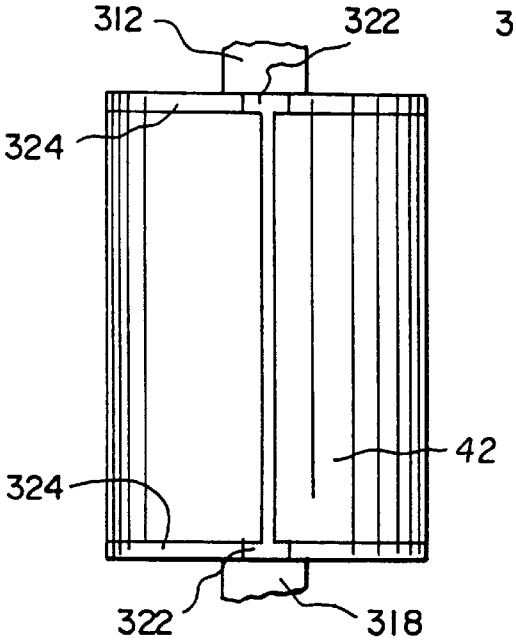

The dye collection support sheet 45 when mounted on the vacuum imaging drum is seated within the circumferential recess 326, as shown FIG. 9*a*–9*c*. The donor support rings 324 have a thickness substantially equal to the dye collection support sheet 45 thickness seated there between which is approximately 0.1 mm in thickness. The purpose of the circumferential recess 326 on the vacuum imaging drum 300 surface is to eliminate any creases in the imagesetter film sheet 42, as it is they are drawn down over the dye collection support sheet 45 during the loading of the imagesetter film sheet 42. This ensures that no folds or creases will be generated in the imagesetter film sheet 42 which could extend into the image area and seriously adversely affect the intended image. The circumferential recess 326 also substantially eliminates the entrapment of air along the edge of the dye collection support sheet 45, where it is difficult for the vacuum holes 306 in the vacuum imaging drum 300 surface to assure the removal of the entrapped air. Any residual air between the dye collection support sheet 45 and the imagesetter film sheet 42, can also adversely affect the intended image.

The invention has been described with reference to the preferred embodiment thereof. However, it will be appreciated and understood that variations and modifications can be effected within the spirit and scope of the invention as described herein above and as defined in the appended claims by a person of ordinary skill in the art without departing from the scope of the invention. For example, during proofing, the dye collection support could be exited from the time after imaging the imagesetter film and stored in a holding tray for reuse.

PARTS LIST

10 Image processing apparatus
12 Image processor housing
14 Image processor door
16 Donor ejection chute
18 Donor waste bin
20 Media stop
30 Roll media
32 Thermal print media
34 Dye donor roll material
36 Dye donor sheet material
40 Imagesetter Film roll material
42 Imagesetter Film sheet material
44 Dye collection support roll material
45 Dye collection support sheet material
50 Sheet material trays
50*a* Lower sheet material tray
50*b* Upper sheet material tray
52 Media lift cams
52*a* Lower media lift cam
52*b* Upper media lift cam
54 Media rollers
54*a* Lower media roller
54*b* Upper media roller
56 Media guide
58 Media guide rollers
60 Media staging tray
80 Transport mechanism
100 Media carousel
110 Media drive mechanism
112 Media drive rollers
120 Media knife assembly
122 Media knife blades
180 Color binding assembly
182 Media entrance door
184 Media exit door
200 Lathe bed scanning subsystem
202 Lathe bed scanning frame
204 Entrance passageway
206 Rear translation bearing rod
208 Front translation bearing rod
220 Translation stage member
222 Vacuum fitting
224 Vacuum blower
250 Lead screw
252 Threaded shaft
254 Lead screw drive nut
256 Drive coupling
258 Linear drive motor
260 Axial load magnets
260*a* Axial load magnet
260*b* Axial load magnet
262 Circular-shaped boss
264 Ball bearing
266 Circular-shaped insert
268 End cap
270 Hollowed-out center portion
300 Vacuum imaging drum
302 Vacuum drum housing
304 Hollowed out interior portion
306 Vacuum hole
308 Vacuum end plate
310 Drive end plate
312 Drive spindle
314 Support bearing
316 DC drive motor armature
318 Vacuum spindle
320 Central vacuum opening
322 Axially extending flat
324 Donor support ring
326 Circumferential recess
332 Vacuum grooves
340 Drive nut
342 DC motor stator
344 Drum encoder
400 Laser assembly
402 Lasers diode
404 Fiber optic cables
406 Distribution block
454 Optical centerline
500 Print head

What is claimed is:

1. A method of exposing imagesetter recording film on a color-proofing apparatus comprising the steps of:

loading a sheet of dye collection support on a vacuum imaging drum;

loading a first sheet of imagesetter recording film in registration with said dye collection support on said vacuum imaging drum, wherein said first sheet of imagesetter recording film is loaded dye side down; and forming a first intended image on said first sheet of imagesetter recording film by removing dye from said first sheet of imagesetter recording film, said removed dye being collected by said dye collection support.

2. A method according to claim 1 comprising the additional steps of:

removing said first sheet of imagesetter recording film;

loading a second sheet of imagesetter recording film in registration with said dye collection support, wherein said second sheet of imagesetter recording film is loaded dye side down; and forming a second intended image on said second sheet of imagesetter recording film by removing dye from said second sheet of imagesetter recording film and collecting said dye on said dye collection support.

3. A method according to claim 2 comprising the additional steps of:

removing said second sheet of imagesetter recording film;

loading a third sheet of imagesetter recording film in registration with said dye collection support, wherein said third sheet of imagesetter recording film is loaded dye side down; and forming a third intended image on said third sheet of imagesetter recording film by removing dye from said imagesetter recording film, said dye being collected by said dye collection support.

4. A method according to claim 3 comprising the additional steps of:

removing said third sheet of imagesetter recording film;

loading a fourth sheet of imagesetter recording film in registration with said dye collection support, wherein said fourth sheet of imagesetter recording film is located dye side down; and forming a fourth intended image on said fourth sheet of imagesetter recording film by removing dye from said fourth sheet of imagesetter recording film, said dye being collected by said dye collection support.

5. A method of exposing imagesetter recording film on a color-proofing apparatus comprising the steps of:

loading a first sheet of dye collection support on a vacuum imaging drum;

loading a first sheet of imagesetter recording film in registration with said first sheet of dye collection support, wherein said first sheet of imagesetter recording film is loaded dye side down; and forming an intended image on said first sheet of imagesetter recording film by removing dye from said first sheet of imagesetter recording film, said dye being collected by said first sheet of dye collection support.

6. A method according to claim 5 comprising the additional steps of:

removing said first sheet of imagesetter recording film;

removing said first sheet of dye collection support;

loading a second sheet of dye collection support;

loading a second sheet of imagesetter recording film in registration with said second sheet of dye collection support, wherein said second sheet of imagesetter recording film is loaded dye side down; and forming a second intended image on said second sheet of imagesetter recording film by removing dye from said second sheet of imagesetter recording film, said dye being collected by said second sheet of dye collection support.

7. A method according to claim 5 comprising the additional steps of:

removing said second sheet of imagesetter recording film;

removing said second sheet of dye collection support;

loading a third sheet of dye collection support;

loading a third sheet of imagesetter recording film in registration with said third sheet of dye collection support, wherein said third sheet of imagesetter recording film is loaded dye side down; and forming a third intended image on said third sheet of imagesetter recording film by removing dye from said third sheet of imagesetter recording film, said dye being collected by said third sheet of dye collection support.

8. A method according to claim 5 comprising the additional steps of:

removing said third sheet of imagesetter recording film;

removing said third sheet of dye collection support;

loading a fourth sheet of dye collection support;

loading a fourth sheet of imagesetter recording film in registration with said fourth sheet of dye collection support, wherein said fourth sheet of imagesetter recording film is loaded dye side down; and forming a fourth intended image on said fourth sheet of imagesetter recording film by removing dye from said fourth sheet of imagesetter recording film, said dye being collected by said fourth sheet of dye collection support.

9. A method as in claim 5 wherein said first dye collection support is loaded in a recess on said vacuum imaging drum.

10. A method according to claim 9 wherein said recess has a depth substantially equal to a thickness of said dye collection support.

11. A method as in claim 5 wherein a laser removes said dye from said first sheet of imagesetter recording film.

12. A method of writing images to imagesetter recording film on a color-proofing apparatus comprising the steps of:

loading a sheet of thermal print media on a drum;

mounting a first sheet of dye donor material on said drum in registration with said sheet of thermal print media;

transferring dye from said first sheet of dye donor material to said thermal print media;

removing said first sheet of dye donor material from said drum;

mounting a second sheet of dye donor material on said drum in registration with said thermal print media;

transferring dye from said second dye donor sheet to said thermal print media;

removing said second dye donor sheet from said drum;

mounting a third sheet of dye donor material on said drum in registration with said thermal print media;

transferring dye from said third dye donor sheet to said thermal print media;

removing said third sheet of dye donor material from said drum;

removing said thermal print media from said drum;

mounting a dye collection support on said drum;

mounting a first sheet of imagesetter recording film on said drum, wherein said first sheet of imagesetter recording film is loaded dye side down;

producing a first image on said first sheet of imagesetter recording film;

removing said first sheet of imagesetter recording film from said drum;

mounting a second sheet of imagesetter recording film in registration with said dye collection support, wherein said second sheet of imagesetter recording film is loaded dye side down;

producing a second image on said second sheet of imagesetter recording film;

removing said second sheet of imagesetter recording film from said drum;

mounting a third sheet of imagesetter recording film in registration with said dye collection supports wherein said third sheet of imagesetter recording film is loaded dye side down;

producing a third image on said third sheet of imagesetter recording film; and removing said third sheet of imagesetter recording film from said drum.

* * * * *